US006093922A

United States Patent [19]

Kim

[11] Patent Number: 6,093,922

[45] Date of Patent: Jul. 25, 2000

[54] WALL MOUNTED MICROWAVE OVEN AND CONTROL METHOD THEREFOR

[75] Inventor: Sun Ki Kim, Kyungki-do, Rep. of Korea

[73] Assignee: Samsung Electronics Co., Ltd., Suwon, Rep. of Korea

[21] Appl. No.: 09/266,758

[22] Filed: Mar. 12, 1999

[30] Foreign Application Priority Data

Jul. 23, 1998 [KR] Rep. of Korea ..... 98-29663

[51] Int. Cl.[7] ..... H05B 6/68

[52] U.S. Cl. ..... 219/757; 219/710; 219/716; 126/21 A; 126/273 A; 126/299 D

[58] Field of Search ..... 219/757, 710, 219/702, 716; 126/21 A, 273 A, 299 R, 299 D

[56] References Cited

U.S. PATENT DOCUMENTS

| | | | |
|---|---|---|---|
| 3,934,494 | 1/1976 | Butler | 454/356 |
| 4,143,646 | 3/1979 | Sampsel | 126/299 D |
| 4,231,765 | 11/1980 | Scott | 126/299 E |
| 4,251,026 | 2/1981 | Siegel et al. | 236/49.3 |
| 4,327,274 | 4/1982 | White et al. | 219/757 |
| 4,886,046 | 12/1989 | Welch | 219/757 |

*Primary Examiner*—Philip H. Leung
*Attorney, Agent, or Firm*—Burns, Doane, Swecker & Mathis, L.L.P.

[57] ABSTRACT

Disclosed is a wall mounted microwave oven including a body forming a cavity for accommodating the food to be cooked, a casing enclosing said body and having an inlet port and an outlet port respectively at the bottom part and on the top part thereof, to form a hood duct, and a hood fan being installed within said hood duct, comprising: a first switching part disposed on a main power source line interconnecting said hood fan and a power source, for switching on or off power transmission to said hood fan, a sensing switching part disposed on a sub power source line connected in parallel to said main power source line, and being turned automatically on or off depending on ambient temperature to switch on said hood fan when ambient temperature is over a predetermined temperature, and a second switching part disposed on said sub power source line, and being turned manually on or off to allow said hood fan to be switched of during said sensing switching part is on. With this configuration, the user can stop said hood fan while said hood fan automatically operates due to turn-on of said hood sensor, thereby reducing unnecessary consumption of power and noise of operation.

3 Claims, 4 Drawing Sheets

WALL MOUNTED MICROWAVE OVEN AND CONTROL METHOD THEREFOR

BACKGROUND OF THE INVENTION

1. Field of the Invention

The present invention relates to a wall mounted microwave oven and a control method therefor, more particularly, to a wall mounted microwave oven and a control method therefor, capable of stopping power supply to a hood fan by a user while said hood fan is automatically being turned on by a hood sensor switch due to increased ambient temperature. With this, unnecessary consumption of the power can be avoided and noise generated from operation of said hood fan can be reduced 2. Prior Art As illustrated in FIG. 1, a wall mounted microwave oven is mounted on a wall above a gas range 50, and serving as a hood, has a function of inhaling vapor and fumes generated while food is being cooked in the gas range 50. As shown in FIGS. 1 and 2, the wall mounted microwave oven is comprised of a body 3 having a cavity 4 in which the food are cooked, and a casing 6 surrounding the body 3. A magnetron 30 which supplies high frequency electromagnetic waves into the cavity 4 is mounted between said cavity 4 and said casing 6. The magnetron 30 receives a high-tension current through a high-voltage transformer (not shown) and a high-voltage capacitor (not shown).

Meanwhile, the casing 6 includes an upper casing 6*a* surrounding the upper portion of the body 3 and a lower casing 6*b* combined with the lower portion of the body 3. A hood duct 15 as a path for exhausting vapor and fume is formed in the space between the casing 6 and the body 3. An inlet port 8 for inhaling vapor and fumes into the hood duct 15 is formed on the lower casing 6*b* and an outlet port 9 is formed on the upper surface of the upper casing 6*a*. An exhaust pipe 11 is connected to said outlet port 9. Said exhaust pipe 11 is connected to an exhaust path 17 penetrating the wall to communicate with the air. A hood fan 13 is installed in the upper portion of the body 3 in the vicinity of the outlet port 9, to exhaust the vapor and the fume inhaled into the hood duct 15 via the inlet port 8 to the air via the outlet port 9.

From the control panel, a user can choose to operate said hood fan 13 at low speed or at high speed. As being the case, a hood sensor switch is provided in the inlet port 8 or the inner portion of the hood duct 15, so as to supply power to the hood fan 13 or isolate the hood fan 13 from power, according to the sensed temperature of ambient air. Generally, the on- or the off-temperatures for the hood sensor switch are set, so the hood sensor switch can be on or off when the ambient temperature reaches any of the set temperatures.

With reference to the circuit diagram shown in FIG. 3, driving circuit for a wall mounted microwave oven includes: a hood fan motor 20 connected to normal AC power source 61, power switching part 22 for applying or not power to said hood fan motor 20, a selection switching part 23 for selecting whether to drive said hood fan motor 20 at low or high speed, and a hood sensor switching part 27 disposed in parallel with said power switching part 22 for automatically operating said hood fan motor 20 when ambient temperature is over a predetermined temperature. Said selection switching part 23 is connected to a high speed node 23*a* to operate said hood fan motor 20 at high speed and to a low speed node 23*b* to operate the same at low speed, according to said controller 10.

Although a user does not wish to operate said hood fan 13, said hood motor 20 automatically starts to operate by said sensing switching part 27 when ambient temperature increases and is over a predetermined temperature (normally 70° C.) due to, e.g., use of a gas range. Said hood fan motor 20 continues to operate (normally for 20 to 30 minutes) until the ambient temperature decreases and is below a predetermined temperature (normally 40° C.).

Even if the user wishes to stop said hood fan motor 20 while said hood fan motor 20 is being automatically operated by said sensing switching part 27, he/she cannot do so because there are provided no means therefor.

Although said hood fan 13 is unnecessary to operate when ambient temperature does not raise any more, the user has to wait until said hood fan 13 automatically stops. In this case, said hood fan 13 is unnecessarily operating until said sensing switching part 27 is opened, thereby causing noise of operation and unnecessary consumption of electric power.

SUMMARY OF THE INVENTION

To solve the above-described shortcoming, it is the object of the present invention to provide a wall mounted microwave oven which enables the user to turn off power source of the hood fan motor if necessary and a control method therefor.

BRIEF DESCRIPTION OF THE DRAWINGS

The above object and advantages of the present invention will be apparent by describing the structure and operation thereof in detail with reference to the attached drawings in which.

DETAILED DESCRIPTION OF THE PREFERRED EMBODIMENTS

Preferred embodiments of the present invention will be described in detail with reference to the accompanying drawings.

To accomplish the object of the present invention, there is provided a wall mounted microwave oven including a body forming a cavity for accommodating the food to be cooked, a casing enclosing said body and having an inlet port and an outlet port respectively at the bottom part and on the top part thereof, to form a hood duct, and a hood fan being installed within said hood duct, comprising: a first switching part disposed on a main power source line interconnecting said hood fan and a power source, for switching on or off power transmission to said hood fan; a sensing switching part disposed on a sub power source line connected in parallel to said main power source line, and being turned automatically on or off depending on ambient temperature to switch on said hood fan when ambient temperature is over a predetermined temperature; and a second switching part disposed on said sub power source line, and being turned manually on or off to allow said hood fan to be switched of during said sensing switching part is on.

Preferably, said first switching part and said second switching part are relay switches.

To accomplish the object of the present invention, there is provided a control method for a wall mounted microwave oven including a body forming a cavity for accommodating the food to be cooked, a casing enclosing said body and having an inlet port and an outlet port respectively at the bottom part and on the top part thereof, to form a hood duct, and a hood fan being installed within said hood duct, comprising the steps of: detecting ambient temperature of said oven; driving said hood motor when the detected temperature is over a predetermined temperature; and stopping said hood motor by a user while said motor operates based on the detected temperature.

Hereinbelow, the present invention will be described in detail with reference to accompanying drawings.

Figure 1:
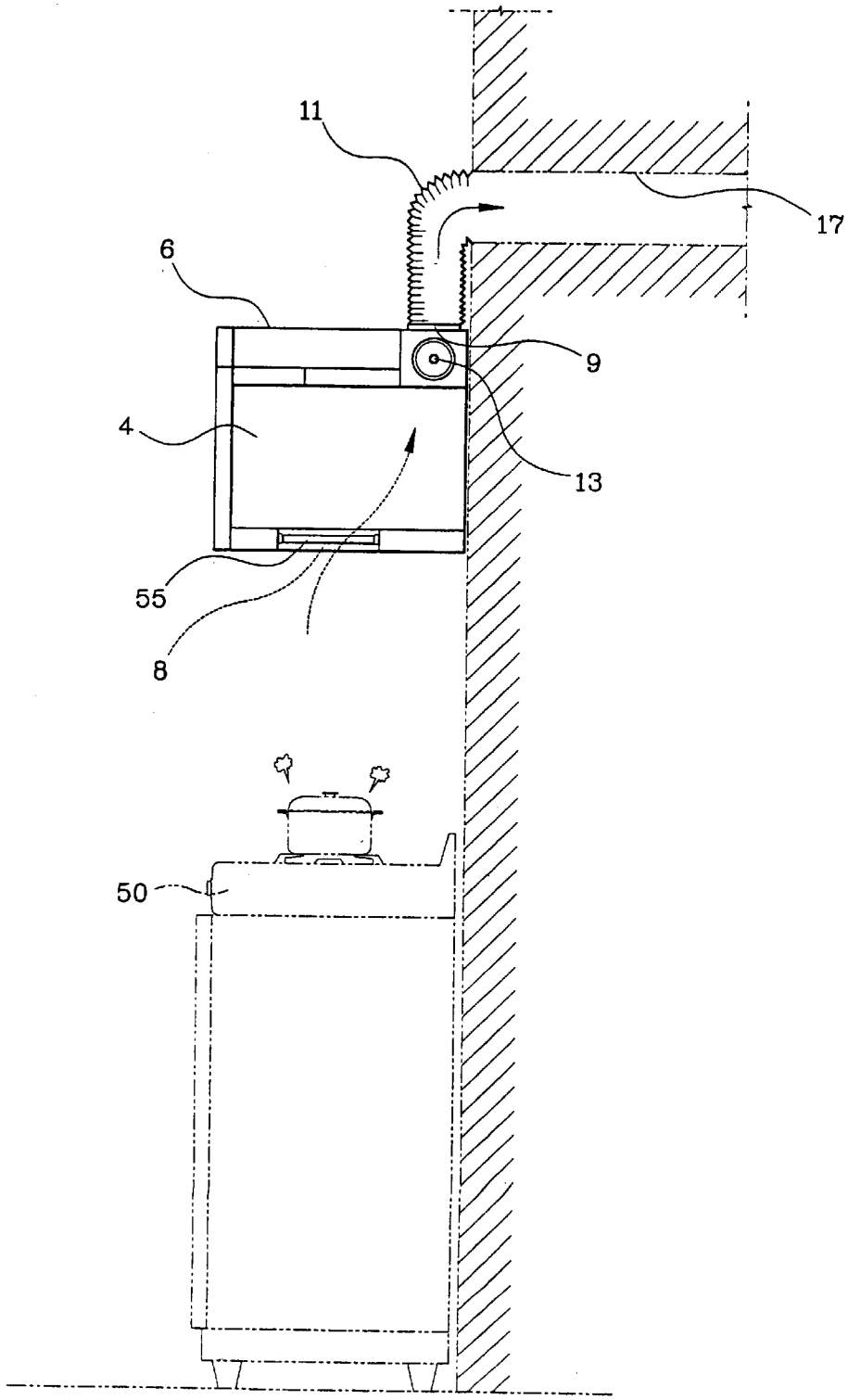
FIG. 1 is a schematic view showing a configuration of a wall mounted microwave oven according to the present invention when it has been installed on a wall.
Figure 2:
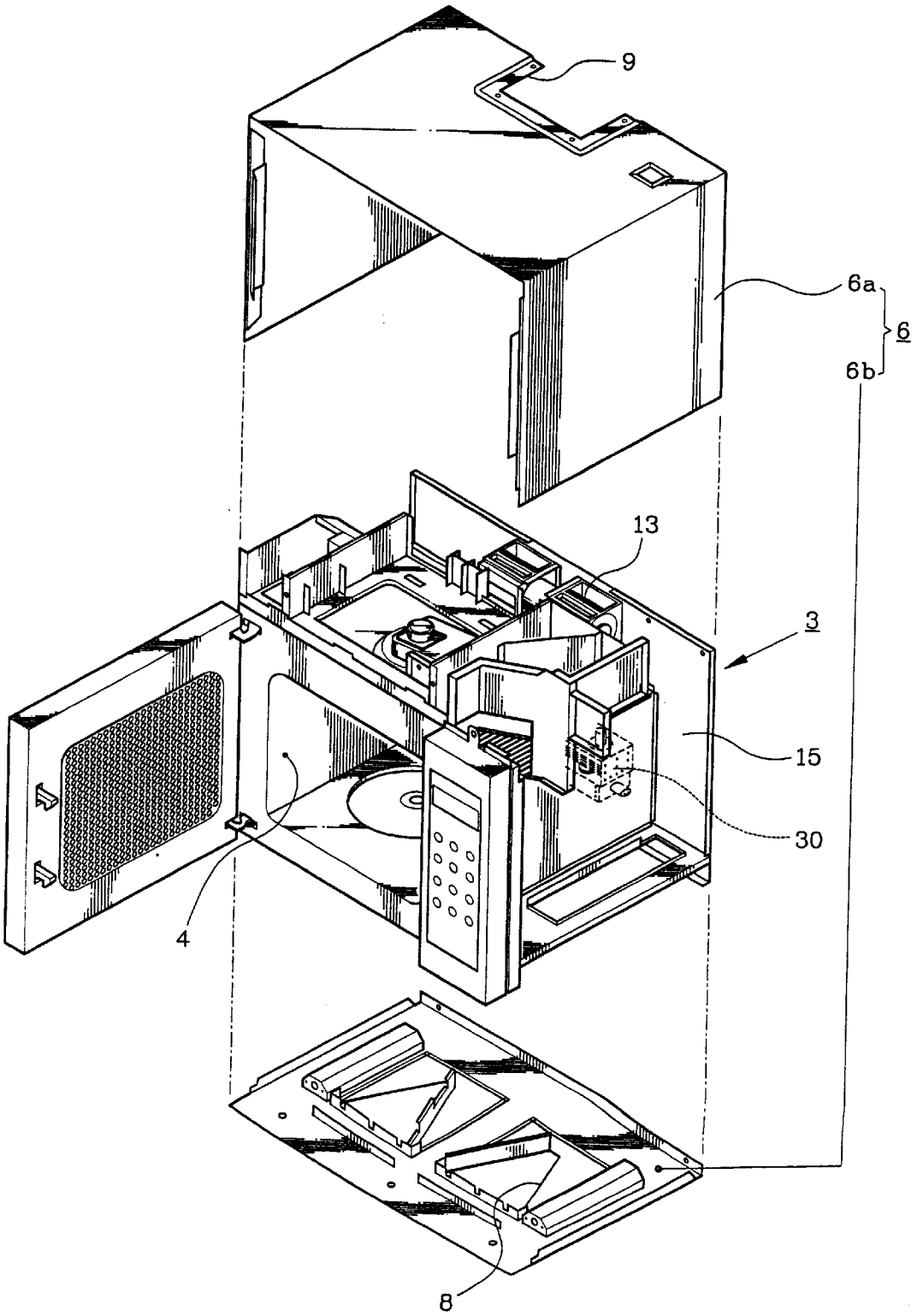
FIG. 2 is a partially exploded perspective view showing a wall mounted microwave oven according to the present invention.
Figure 3:
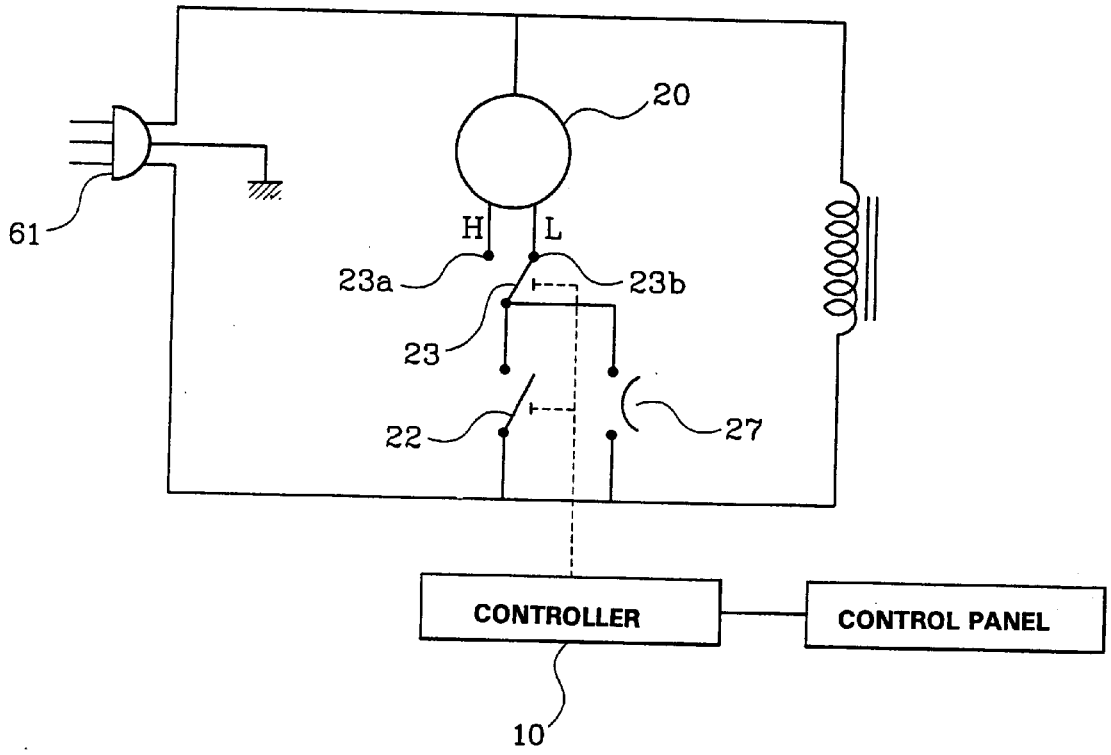
FIG. 3 (PRIOR ART)
FIG. 3 is a circuit diagram of a conventional wall mounted microwave oven.

A wall mounted microwave oven according to the present invention has the same configuration as described in FIGS. 1 and 2, and thus, configuration thereof will be omitted herein.

Figure 4:
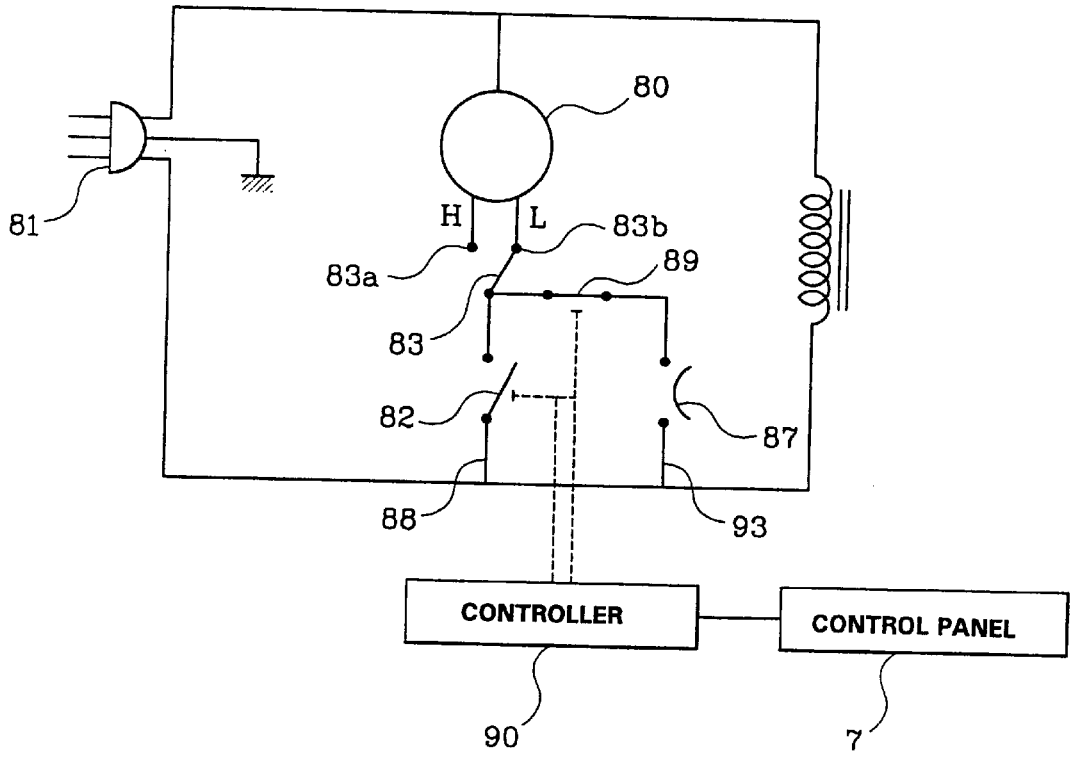
FIG. 4 is a circuit diagram of a wall mounted microwave oven according to the present invention.

FIG. 4 is a circuit diagram of a wall mounted microwave oven according to the present invention.

As illustrated, the driving circuit of a wall mounted microwave oven according to the present invention includes: a hood fan motor 80 connected to normal AC power source 81, a first switching part 82 for applying or not power to said hood fan motor 80, a selection switching part 83 for selecting whether to drive said hood fan motor 80 at low speed or at high speed, and for automatically operating (normally for 20 to 30 minutes) said hood fan motor 80 by being turned on when ambient temperature is over a predetermined temperature (normally 70° C.), and for automatically stopping said hood fan motor 80 by being turned off when ambient temperature sensed by a sensing switching part 87 is below a predetermined temperature (normally 40° C.), and a second switching part 89 for applying or not power to said hood fan motor 80.

A sub power line 93 is connected in parallel with a main power line 88 which connects normal AC power source 81 to said first switching part 82 and said selection switching part 83, respectively, wherein said first and second switching parts 82 and 83 are connected in series. Said sensing switching part 87 and said second switching part 89 are connected on said sub power line 93.

In normal condition that the user does not operate said hood fan motor 80, said first switching part 82 remains opened, whereas said selection switching part 83 remains closed by being connected to the low speed node 83*b*, and said second switching part 89 is also closed.

When the user selects a high speed mode from the control panel 7, said first switching part 82 is controlled to be turned on by a controller 90, and said selection switching part 83 is connected to a high speed node 83*a*, thereby automatically operating said hood fan motor 80. Likewise, when the user selects a low speed mode, said first switching part 82 is closed, and said selection switching part 83 is maintained as being connected to a low speed node 83*a* as in the normal state, thereby operating said hood fan motor 80 at low speed. Meanwhile, when said hood fan motor 80 is operated at high speed or at low speed, depending on the user's selection, said second switching part 89 is set to be maintained as being closed as in the normal condition.

Even if the user does not operate said hood fan motor 80, said sensing switching part 87 is closed and said hood fan motor 80 starts to operate at low speed when ambient temperature raises over a predetermined temperature (normally 70° C.) due to, e. g., use of the gas range installed below. Said hood fan motor 80 continues to operate (for about 20 to 30 minutes) until said sensing switching part 87 is opened as ambient temperature decreases below a predetermined temperature (normally 40° C.) as time has passed.

When the user wishes to stop automatic operation of said hood fan after completing using the gas range, he operates the control panel 7 to turn off said second switching part 89, so said hood fan motor 80 is stopped.

As described above, according to the present invention, the user can stop said hood fan if necessary while said hood fan is in operation by said hood sensor switch, thereby reducing unnecessary consumption of power and noise of operation.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A wall mounted microwave oven including a body forming a cavity for accommodating the food to be cooked, a casing enclosing said body and having an inlet port and an outlet port respectively at the bottom part and on the top part thereof, to form a hood duct, and a hood fan being installed within said hood duct, comprising:

a manually actuated first switching part disposed on a main power source line interconnecting said hood fan and a power source, for switching on or off power transmission to said hood fan;

a sensing switching part disposed on a sub power source line connected in parallel to said main power source line, and being turned automatically on or off depending on ambient temperature, to switch on said hood fan when ambient temperature is over a predetermined temperature; and a manually actuated second switching part disposed on said sub power source line, and being turned manually on or off to allow said hood fan to be switched off when said sensing switching part is on.

2. A wall mounted microwave oven according to claim 1, wherein said first switching part and said second switching part are relay switches.

3. A control method for a wall mounted microwave oven including a body forming a cavity for accommodating the food to be cooked, a casing enclosing said body and having an inlet port and an outlet port respectively at the bottom part and on the top part thereof, to form a hood duct, and a hood fan being installed within said hood duct, comprising the steps of:

detecting ambient temperature of said oven;

automatically driving said hood motor in response to the detected temperature being over a predetermined temperature; and manually stopping said hood motor by a user while said motor operates based on the detected temperature.

* * * * *